US008210191B2

(12) United States Patent
Gnadinger et al.

(10) Patent No.: US 8,210,191 B2
(45) Date of Patent: Jul. 3, 2012

(54) DISHWASHER HAVING MULTI-MODE SPRAY ARM SYSTEM

(75) Inventors: Errin Whitney Gnadinger, Louisville, KY (US); Mohan Ponnaganti, Hyderabad (IN)

(73) Assignee: General Electric Company, Schenectady, NY (US)

( * ) Notice: Subject to any disclaimer, the term of this patent is extended or adjusted under 35 U.S.C. 154(b) by 724 days.

(21) Appl. No.: 12/330,722

(22) Filed: Dec. 9, 2008

(65) Prior Publication Data

US 2010/0139719 A1 Jun. 10, 2010

(51) Int. Cl.

| | |
|---|---|
| ***B08B 3/00*** | (2006.01) |
| ***B08B 3/12*** | (2006.01) |
| ***B08B 6/00*** | (2006.01) |

(52) U.S. Cl. ..... 134/178; 134/56 D; 134/57 D; 134/58 D; 134/172; 134/174; 134/176; 134/179

(58) Field of Classification Search ..... 134/56 D, 134/57 D, 58 D, 172, 174, 176, 178, 179
See application file for complete search history.

(56) References Cited

U.S. PATENT DOCUMENTS

| | | | | |
|---|---|---|---|---|
| 3,941,139 | A * | 3/1976 | Spiegel | 134/176 |
| 3,969,137 | A | 7/1976 | Jenkins | |
| 4,175,575 | A | 11/1979 | Cushing | |
| 4,210,285 | A | 7/1980 | Dicken | |
| 4,509,687 | A | 4/1985 | Cushing | |
| 5,546,968 | A * | 8/1996 | Jeon et al. | 134/179 |
| 5,681,401 | A | 10/1997 | Gardner | |
| 5,727,581 | A | 3/1998 | Tekriwal | |
| 5,810,035 | A | 9/1998 | Tekriwal | |
| 5,954,073 | A | 9/1999 | Tobbe | |
| 6,605,157 | B2 | 8/2003 | Hegeman | |
| 6,641,058 | B2 | 11/2003 | Hegeman | |
| 6,662,814 | B2 | 12/2003 | Tobbe | |
| 6,698,438 | B2 | 3/2004 | Hegeman | |
| 2007/0006899 | A1 | 1/2007 | Bang | |
| 2007/0068562 | A1 | 3/2007 | Wetzel | |

FOREIGN PATENT DOCUMENTS

| | | | |
|---|---|---|---|
| DE | 3813510 | A * | 11/1989 |
| DE | 3816408 | A * | 11/1989 |
| EP | 0930044 | B1 | 7/1999 |

(Continued)

OTHER PUBLICATIONS

DE 3813510 Machine Translation Nov. 1989 Germany Kafferlein et al.*

(Continued)

*Primary Examiner* — Michael Barr
*Assistant Examiner* — Charles W Kling
(74) *Attorney, Agent, or Firm* — Fay Sharpe LLP

(57) ABSTRACT

A spray assembly for an automatic dishwasher is provided comprising a conduit system for receiving pressurized washing liquid, and an elongated spray arm including an upper surface and a lower surface. The spray arm includes a dividing wall between the upper surface and the lower surface. The spray arm includes a plurality of orifices formed in the upper surface and the lower surface for distributing the liquid throughout the dishwasher. The dividing wall and the upper surface define an upper interior compartment and the dividing wall and the lower surface define a lower interior compartment. The conduit includes a water feed system and a water diverting mechanism for selectively diverting water into the upper compartment, the lower compartment, or both the upper and the lower compartments.

1 Claim, 8 Drawing Sheets

FOREIGN PATENT DOCUMENTS

| | | | | |
|---|---|---|---|---|
| EP | 1040786 | A1 | * | 10/2000 |
| SU | 1080810 | A | * | 3/1984 |
| SU | 1143390 | A | * | 3/1985 |
| SU | 1316654 | A | * | 6/1987 |
| WO | WO 2005072595 | A1 | | 8/2005 |
| WO | WO 2006011773 | A1 | | 2/2006 |

OTHER PUBLICATIONS

SU 1316654 English Translation Jun. 1987 USSR.*

"Staggered Multi-Mode Spray Arm Wash System" filed Dec. 9, 2008, by inventors Errin Whitney Gnadinger, Joseph Duane Tobbe, and Mathew D.Mersch, U.S. Appl. No. 12/330,607.

* cited by examiner

DISHWASHER HAVING MULTI-MODE SPRAY ARM SYSTEM

BACKGROUND

This disclosure relates to dishwashing machines of the type used in households and commercial settings having upper and lower racks within which are arranged articles to be washed. Ordinarily the lower rack is loaded with larger size plates, pots and pans, and the like, and the upper rack is particularly designed to carry the smaller dishes, cups and glassware. Such dishwashing machines normally have one or more spray arms which rotate on a horizontal plane having orifices or jet holes which spray the washing and rinsing liquid upwardly and or downwardly against the dishes in the racks thereabove or therebelow depending on the location of the arm itself. One or more of these orifices or jet holes may be positioned so that the water streams issuing therefrom cause the spray arm itself to rotate thereby achieving maximum coverage of the dishes by the washing liquid.

One of the problems associated with present spray arms, and associated water jets, is that they are typically either all on or all off. A reduction in water pressure and an increase in pump prime requirements usually results from attempting to increase total spray arm flow rate by adding additional jet holes to achieve additional spray arm coverage.

This disclosure attempts to solve a problem inherent to spray arms, including mid-spray or middle spray arms, in which, based on conventional technology, will only spray upward onto the underside of the upper rack, leaving only the lower spray arm as the primary means to wash the lower rack. For example, when using 'single rack wash' in upper rack mode, the upper rack receives downward spray from the upper spray arm, and upward spray from the mid spray arm. However, when applying the current process of 'single rack wash' to the lower rack, only the lower spray arm is utilized, thus only upward spray is produced from the underside of the lower rack.

CROSS REFERENCE

This application references U.S. patent application Ser. No. 12/330,607 entitled "Staggered Multi-Mode Spray Arm Wash System" filed Dec. 9, 2008, by Errin W. Gnadinger et al., the disclosure of which is incorporated herein by reference.

SUMMARY

It is an object of this disclosure to provide an automatic dishwasher with an improved spray arm system having selective and distinct water flow paths that can be activated within the spray arms from a multi-mode water feed system. In addition, the present disclosure provides for independent control of at least two (2) different water circuits within a single spray arm.

In one aspect of the disclosure, a spray assembly for an automatic dishwasher is provided comprising a conduit system for receiving pressurized washing liquid, and an elongated spray arm having at least one radially extending section including upper and lower walls or surfaces. The spray arm includes a dividing wall between the upper and lower surfaces. The spray arm includes a plurality of orifices formed in the upper wall and the lower wall for distributing the liquid throughout the dishwasher. The dividing wall and the upper wall define an upper interior compartment and the dividing wall and the lower wall define a lower interior compartment.

The dual conduit includes a water feed system and a water diverting mechanism for diverting water into the upper compartment, the lower compartment, or both the upper and the lower compartments.

In another aspect of the disclosure, a spray assembly for an automatic dishwasher, having a tub for receiving articles to be washed, is provided comprising a dual conduit system for receiving pressurized washing liquid, and an elongated rotatably mounted spray arm having an inlet hub and at least a first and a second radially extending section extending from the inlet hub. Each section includes a plurality of orifices for distributing the liquid throughout the dishwasher. The dual conduit includes a dual water feed system and a water diverting mechanism for diverting water into the first section, the second section, or both the first and the second sections.

In yet another aspect of the disclosure, a spray assembly for an automatic dishwasher is provided comprising a conduit system for receiving pressurized washing liquid, and an elongated rotatably mounted multi-mode spray arm having at least a first and a second radially extending section. Each section includes a set of orifices for distributing the liquid throughout the dishwasher. The conduit system includes a dual water feed system and a water diverting mechanism for diverting water. The water diverting mechanism is operative to selectively divert water into the first section, the second section, or both the first section and the second section, or alternately into the first and the second sections.

DETAILED DESCRIPTION

A water distribution system is provided in which the spray arm(s) can be controlled to spray upward, downward, both upward and downward, or to alternate between upward and downward by the dishwasher controller.

One feature of this disclosure is the ability for the dishwasher control to select an upward spray mode or a downward spray mode for the middle or mid-spray arm. The result of the aforementioned improved functionality provides enhanced wash performance on the lower rack if the mid-spray arm is used in downward mode. It is to be appreciated, for a 'normal' cycle, the mid spray arm can be oscillated continuously between upward and downward mode (not illustrated). For a single rack wash' mode, the spray arm can be directed exclusively upward (FIG. 2) or exclusively downward (FIG. 3), depending on whether single rack upper or single rack lower is being used.

The present disclosure provides improved wash performance on the lower rack, in both 'normal' wash modes and 'single rack lower' wash modes. It is to be appreciated that independent spray arm controls can impact energy consumption and noise levels. For example, a single rack wash mode only will result in lower energy consumption and lower noise levels as compared to normal wash modes. The dishwasher control system can provide the necessary functional programs to provide either upward or downward spray from a single mid-spray arm.

The embodiments of the proposed mid-spray arms provides for an improvement to the 'single rack wash' cycles on the dishwasher. 'Single rack wash' is currently a dedicated cycle that activates the mid and upper spray arms exclusively, and is intended exclusively for the upper rack. The present disclosure, shown in FIGS. 1-8, provides alternative 'single rack wash' systems with options that can be applied to a variety of different cycles, and will allow the consumer to choose, or alternate, between an 'upper' mode and/or a 'lower' mode in a variety of combinations to be detailed below.

Figure 1:
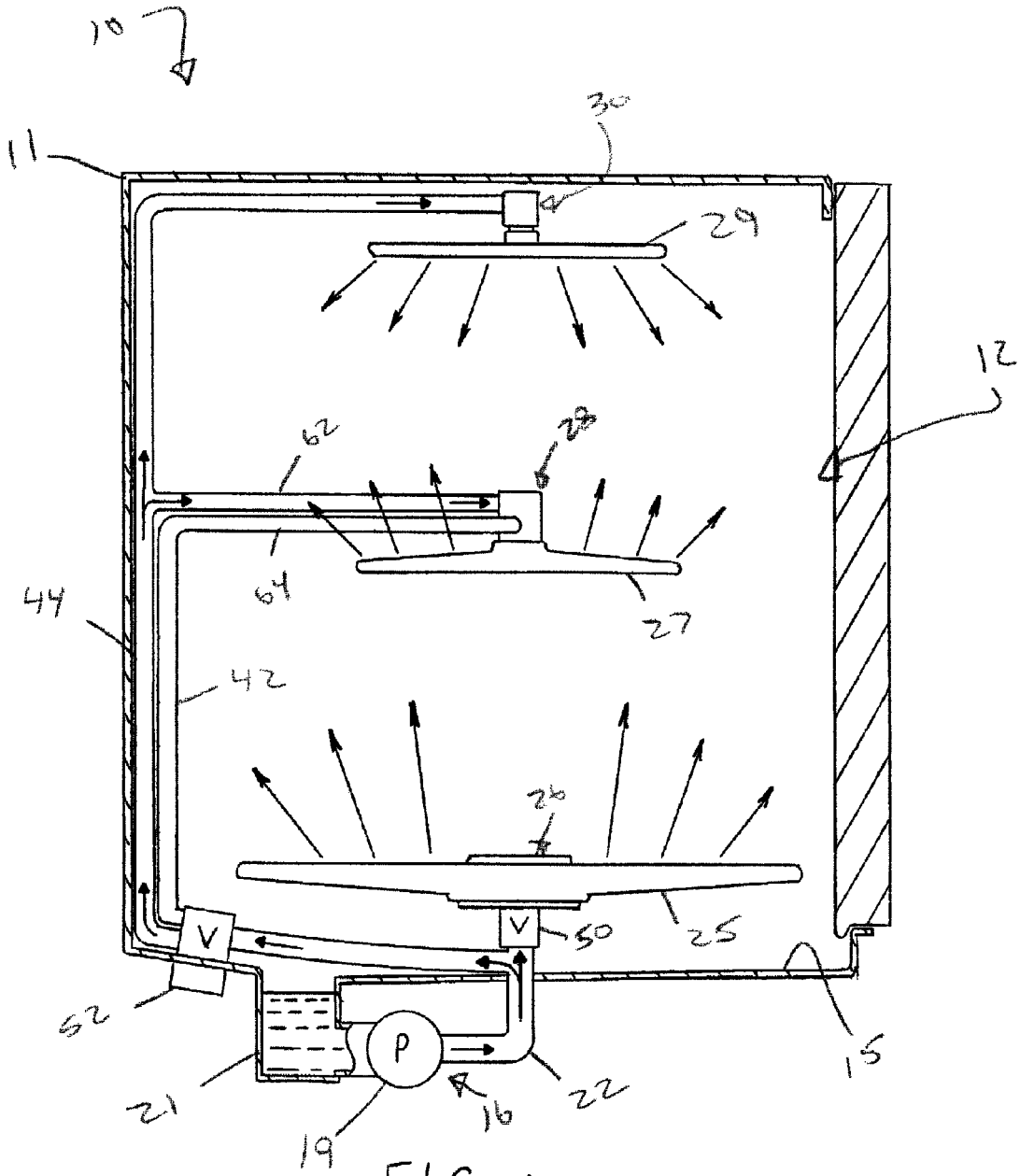
FIG. 1 is a side elevation cut away view of the interior of a dishwashing machine with the spray arms in an operating mode in accordance with the present disclosure.
Figure 2:
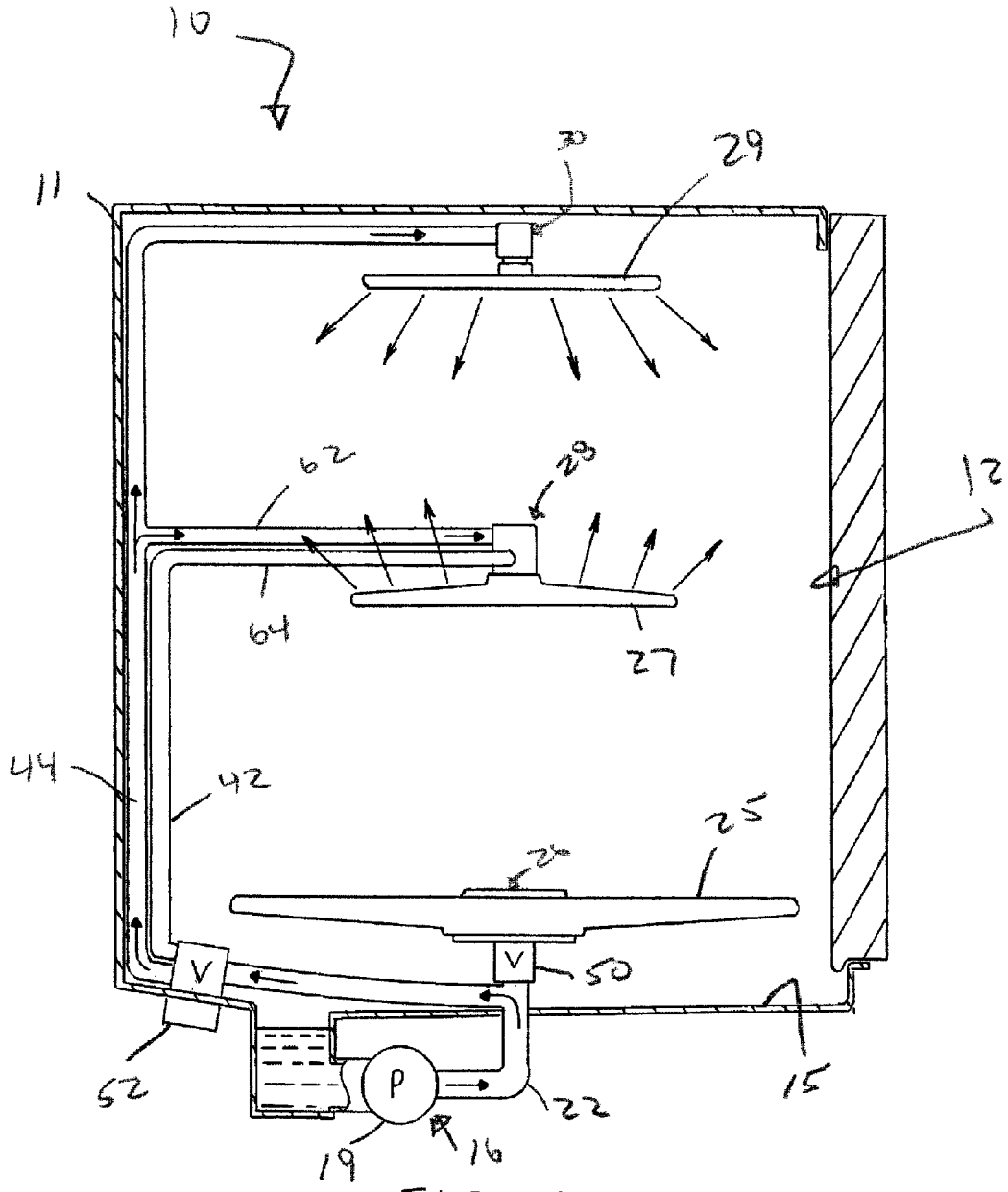
FIG. 2 is a side elevation cut away view of the interior of a dishwashing machine with the spray arms in another operating mode in accordance with the present disclosure.
Figure 3:
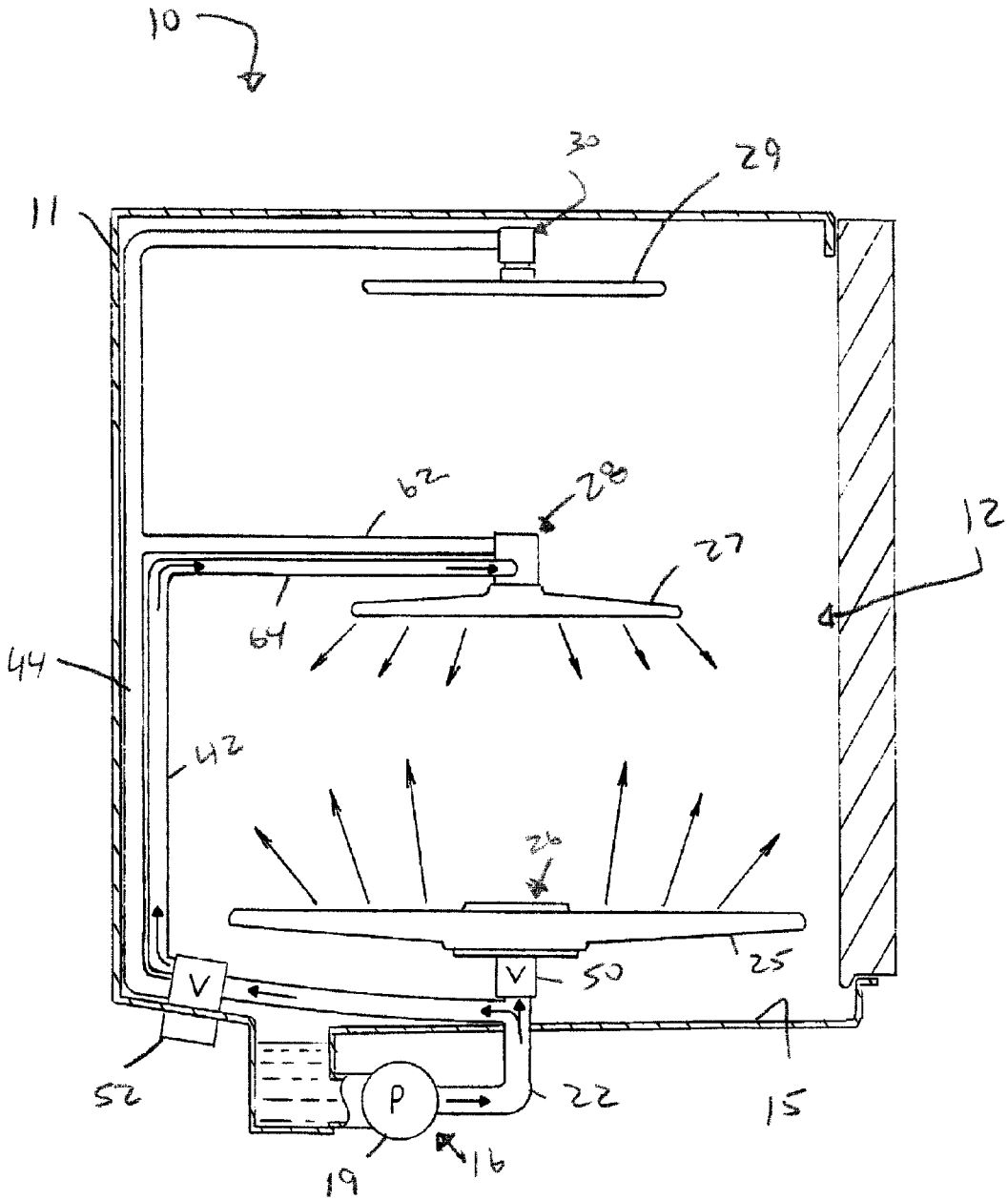
FIG. 3 is a side elevation cut away view of the interior of a dishwashing machine with the spray arms in still another operating mode in accordance with the present disclosure.
Figure 4:
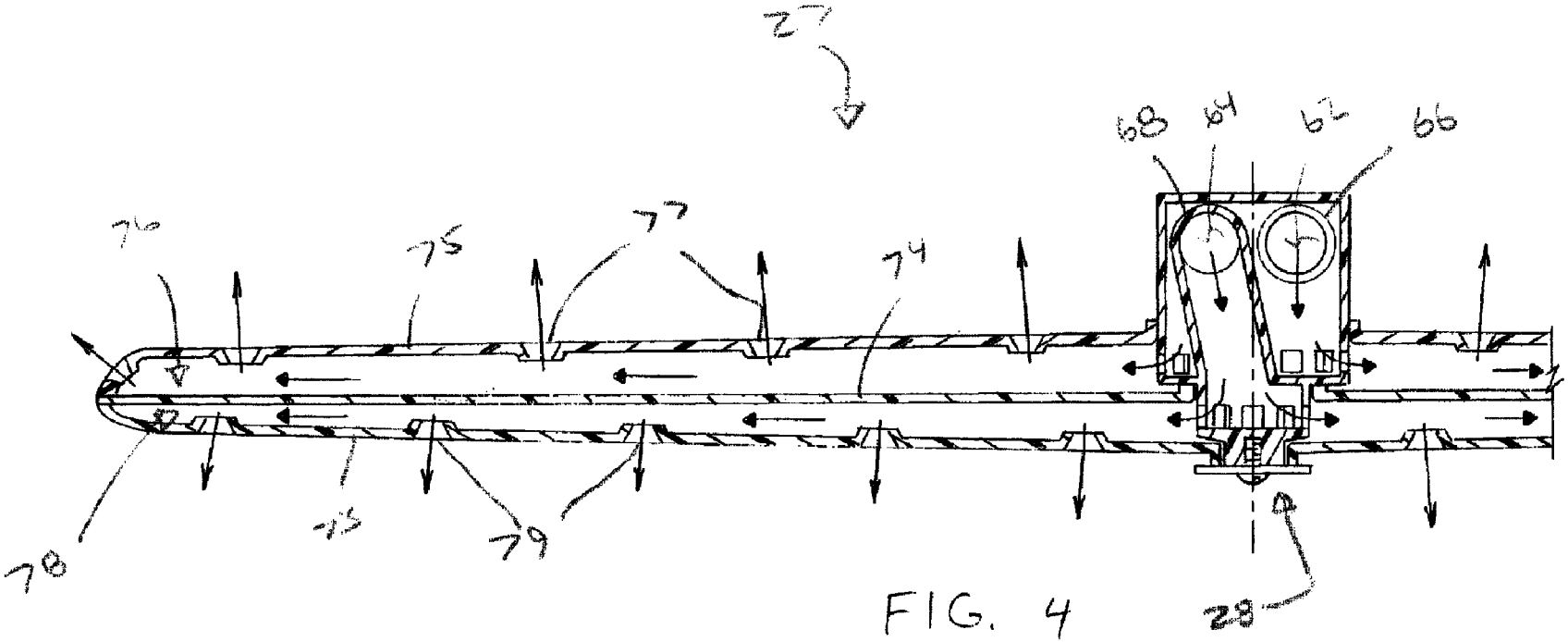
FIG. 4 is a partial cross sectional view of a middle or mid spray arm in accordance with a first embodiment of the present disclosure.
Figure 5:
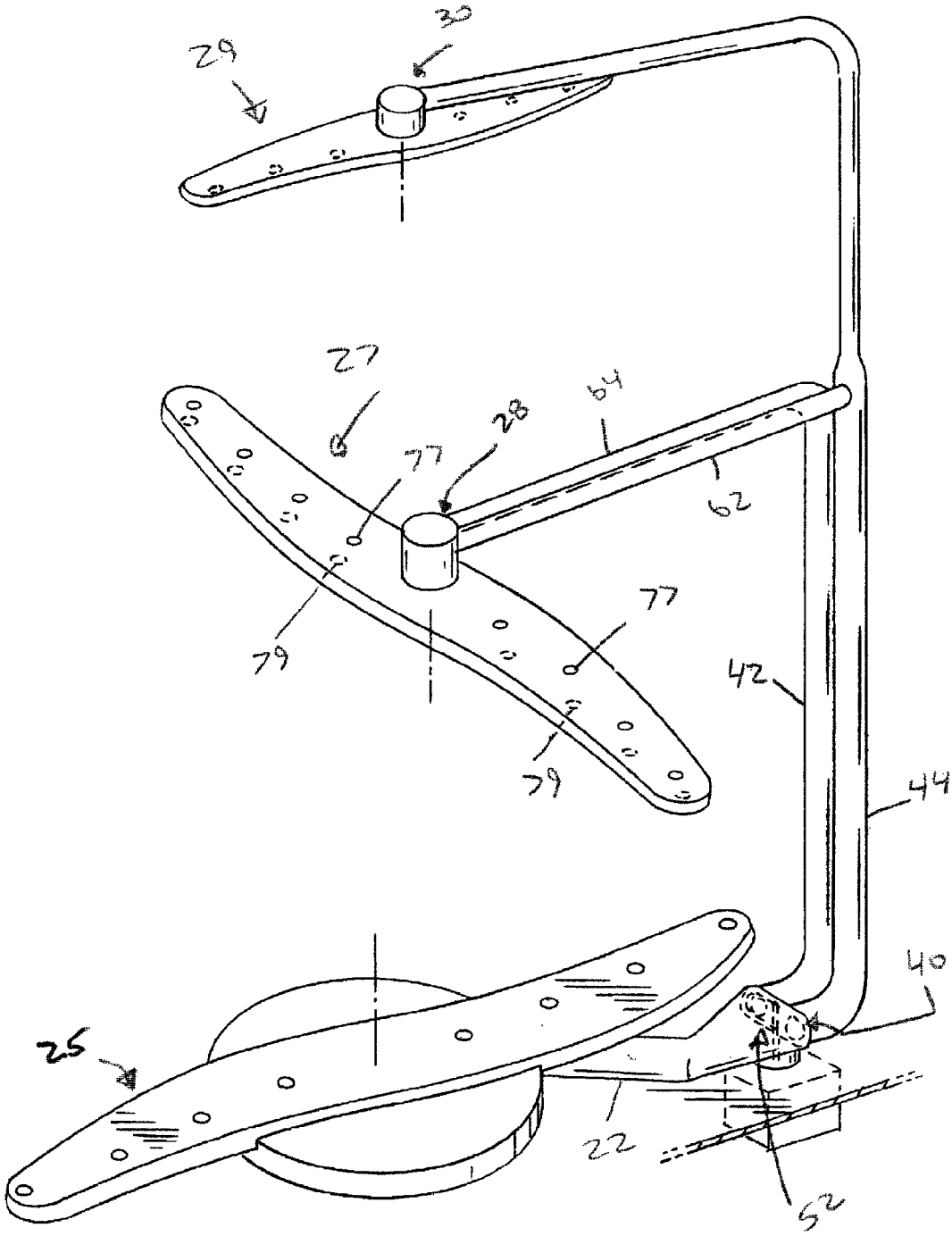
FIG. 5 is a perspective view of the spray arms and conduit system in accordance with the first embodiment of the present disclosure.

As shown in FIGS. 1-3, there is illustrated a cut away view of the interior of an automatic dishwashing machine 10 including a cabinet 11 defining therein a washing chamber or tub 12. Access to the washing chamber or tub 12 is obtained by opening a door pivoted at its lower end and located on the front side of the cabinet 11. Although not illustrated, it is to be appreciated that a dish rack can be supported for slidable movement within the washing chamber 12 so that it may be selectively slid outwardly through the cabinet's front access opening to facilitate loading and unloading of the items to be washed in the machine 10. The lower end of the washing chamber 12 is defined by a bottom wall or floor portion 15 that separates it from a lower motor-pump compartment 16. Housed within the compartment 16 is a motor-pump assembly including an electric motor (not shown) that drives a pump means 19 for recirculating washing liquid to and from the washing chamber 12 and for draining washing liquid from the washing chamber 12 outwardly to the household sewage system. The operational cycle of such a machine generally includes a number of washing and rinsing steps and a final drying step. In a dishwasher machine, such as that shown in FIG. 1, heated water from the household supply line is directed into the washing chamber 12 by valve means actuated by a timer control (not shown). The water accumulates to a predetermined level on the floor portion 15 and then the timer control of the machine causes the electric motor to be energized to drive the pump 19 in a recirculation operation. This method of fill is called the "static" method. A dynamic fill can also be used whereby the motor is energized and the pump goes into the recirculation mode during the time-controlled fill period. In the recirculation operation the accumulated washing liquid is drained out of the washing chamber 12 by means of a sump emptying into a conduit 21 leading to the pump 19. The liquid can then be forced upwardly by the pump 19 through a conduit 22 leading selectively to hollow horizontally elongated spray arms 25, 27, 29 located within the washing chamber 12.

Generally, clean water is introduced into the machine for each wash step and again for each rinse step, and detergent is added, by automatic means (not shown), for the wash step. The term "washing liquid" is therefore used herein in a generic sense to refer broadly to any form of liquid utilized for recirculation within the dishwashing machine. The washing liquid can be selectively distributed from the spray arms 25, 27, 29 by means of orifices spaced therealong. The spray arms 25, 27, 29 can be reactively driven about inlet hubs 26, 28, 30, respectively, by having at least one of the orifices disposed to discharge a jet stream in a direction such that the spray arm reacts to the force of the discharge and rotates in a horizontal plane. A thorough and generally uniform distribution of washing liquid in the washing chamber 12 is thereby obtained. Recirculation of the washing liquid from the washing chamber 12, through the pump 19 and, thence selectively through the spray arms 25, 27, 29, is continued for a predetermined length of time after which the electrical circuit to a drain valve means (not shown) causes the valve to automatically switch an outlet within the pump means 19 so that recirculation ceases and the pump 19 begins to discharge the washing liquid from the washing chamber outwardly through a drain hose leading ultimately to the household sewage system.

Referring now to FIGS. 1-5, a selective spray arm system is provided wherein a water control system is constructed with a dual annulus inlet 40 such that two distinct water flow paths, via conduits 42, 44, can be activated within the spray arm from a dual water feed system. The water feed system can take the embodiment of a multiple conduit system 22, 42, 44, 62, 64 in which a water diverter mechanism such as diverter valves 50, 52 may be controlled to select which path water will flow to the spray arms, thus activating, for example, either an inner 42 or an outer 44 conduit of the spray arm system. A spray arm may possess, for example, a set of upward jets and a set of downward jets that can be activated at different times during the cycle, or a set of upper jets and a separate set of outward spraying jets. One embodiment can provide for the mid spray arm 27 to be controlled to spray upward and/or downward, resulting in improved wash performance on a lower rack while also activating the existing lower spray arm 25. The system may also provide sound reduction and energy reduction benefits that result from the control algorithms and flexibility in spray arm control to be described hereinafter. The present disclosure provides independent control of at least two different water circuits within the same spray arm.

The system can utilize the multiple conduit water supply including diverter valves 50. 52 for selective diversion of the water supply. As shown in FIGS. 1-3 the primary conduit 22, 42, 44 can supply and divert water between the lower spray arm 25, and the middle 27 and upper 29 spray arms. This arrangement of conduit paths enables the diversion of water flow selectively to the mid spray arm 27 and upper spray arm 29.

Referring again to FIGS. 1-5, wherein the additional, dual conduit 62, 64 is therein shown for the mid-spray arm 27. Conduit 62, 64 enables the diversion of water to one mid-spray arm as shown, but could include other or additional intermediate spray arms. The mid spray arm 27 can have a dual inlet annulas 66, 68 and an internal division wall 74 between an upper 76 and lower 78 part such that inlet water flowing to the annulas 66 flows only to the upward orifices 77 of the mid spray arm, and water flowing to the annulas 68 flows only to the lower orifices 79 of the mid spray arm 27. Furthermore, the system can utilize the diverter valve 52 assembled within the main conduit 22 at the location where the main conduit 22 goes from one path to two paths. The diverter valve 52 may consist of a magnetically controlled flapper or ball mechanism where the magnetic transparency of the stainless steel tub bottom may be utilized to keep the electrical portion of the diverter valve 52 on the dry side of the tub.

It is to be appreciated that the total water jet coverage produced by mid spray arm 27 can be essentially doubled to include, for example, a full set of downward orifices 79 in addition to the traditional upward orifices 77. The disclosure provides the ability to double a spray arm's area coverage without inducing a pressure drop in the water system or an increase in the prime (water usage), by providing a water distribution system capable of alternating flow paths (spray arm inlet annuli) throughout the cycle. The system can be optimized to achieve various performance enhancements such as improved wash in a target area of a rack, enhanced and targeted tubular heater jets for higher energy efficiency, as well as other sound reduction and energy efficiency enhancements. One feature of the present disclosure is the ability to selectively enable one of several possible spray modes of a spray arm through the use of: a multi-inlet annulus 66, 68 at the spray arm hub; a multi-water feed system (multi-conduit) 22, 42, 44, 62, 64; and, a water diverting mechanism 50, 52 to divert water into the desired flow path.

Figure 6:
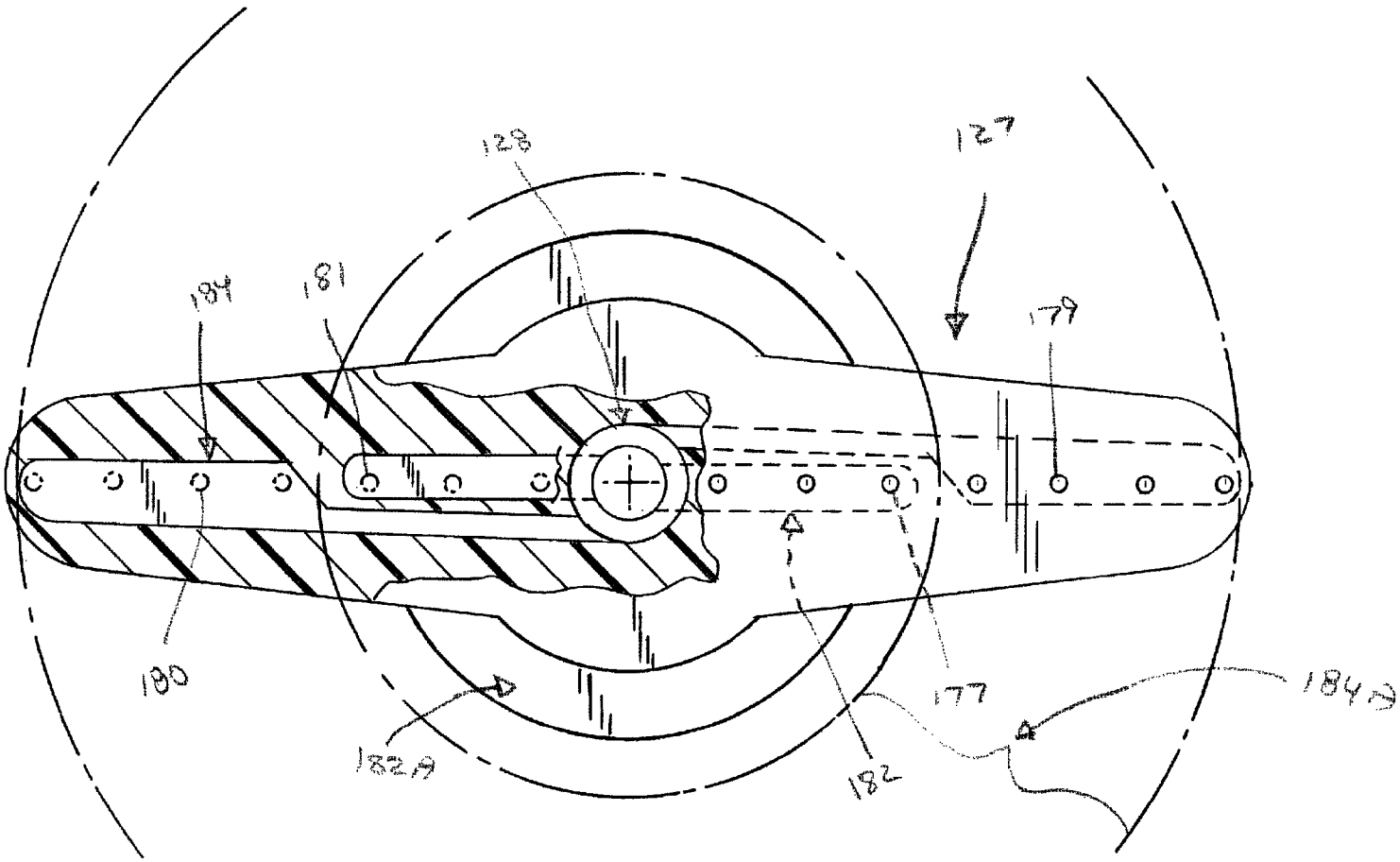
FIG. 6 is a top plan view, partially in section, of a middle spray arm in accordance with a second embodiment of the present disclosure.
Figure 7:
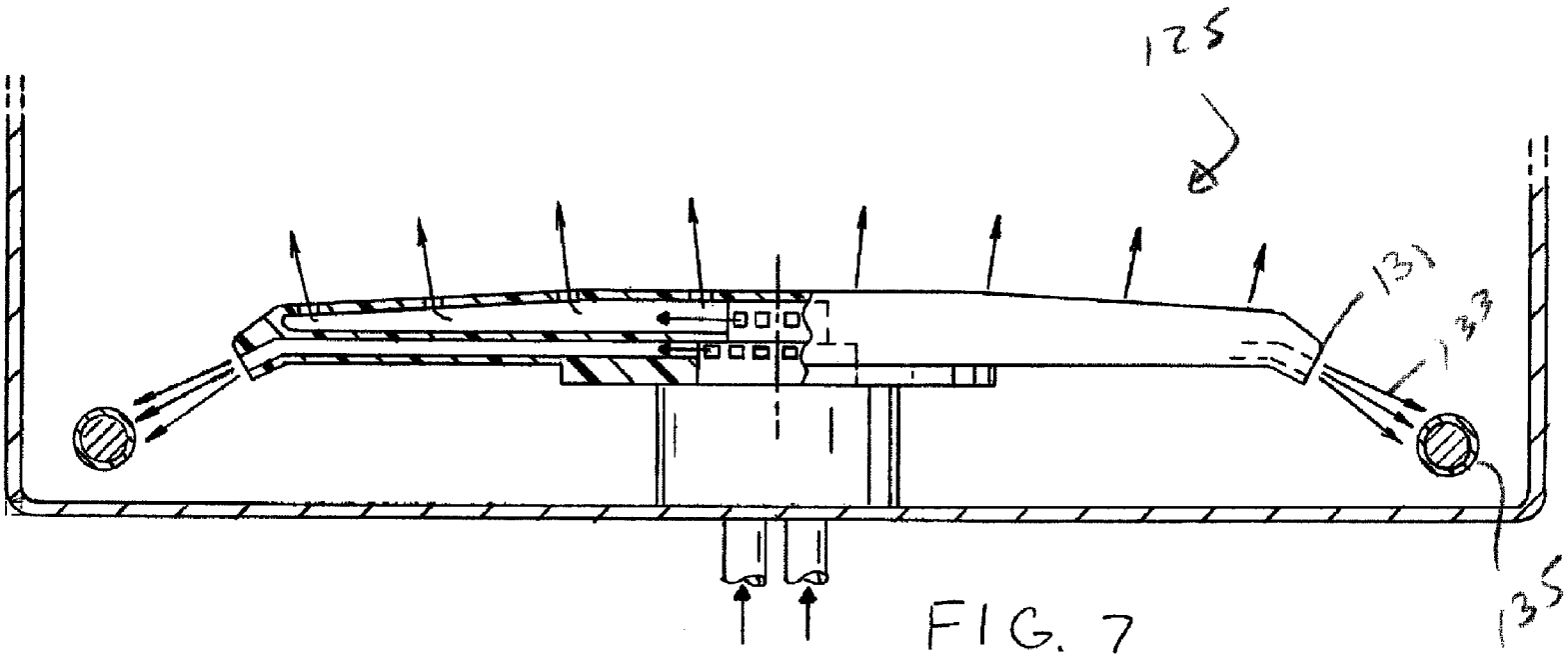
FIG. 7 is a side elevational view of the lower spray arm in accordance with the second embodiment of the present disclosure; and, FIG. 8 is a top plan view of the middle spray arm in accordance with a third embodiment of the present disclosure.
Figure 8:
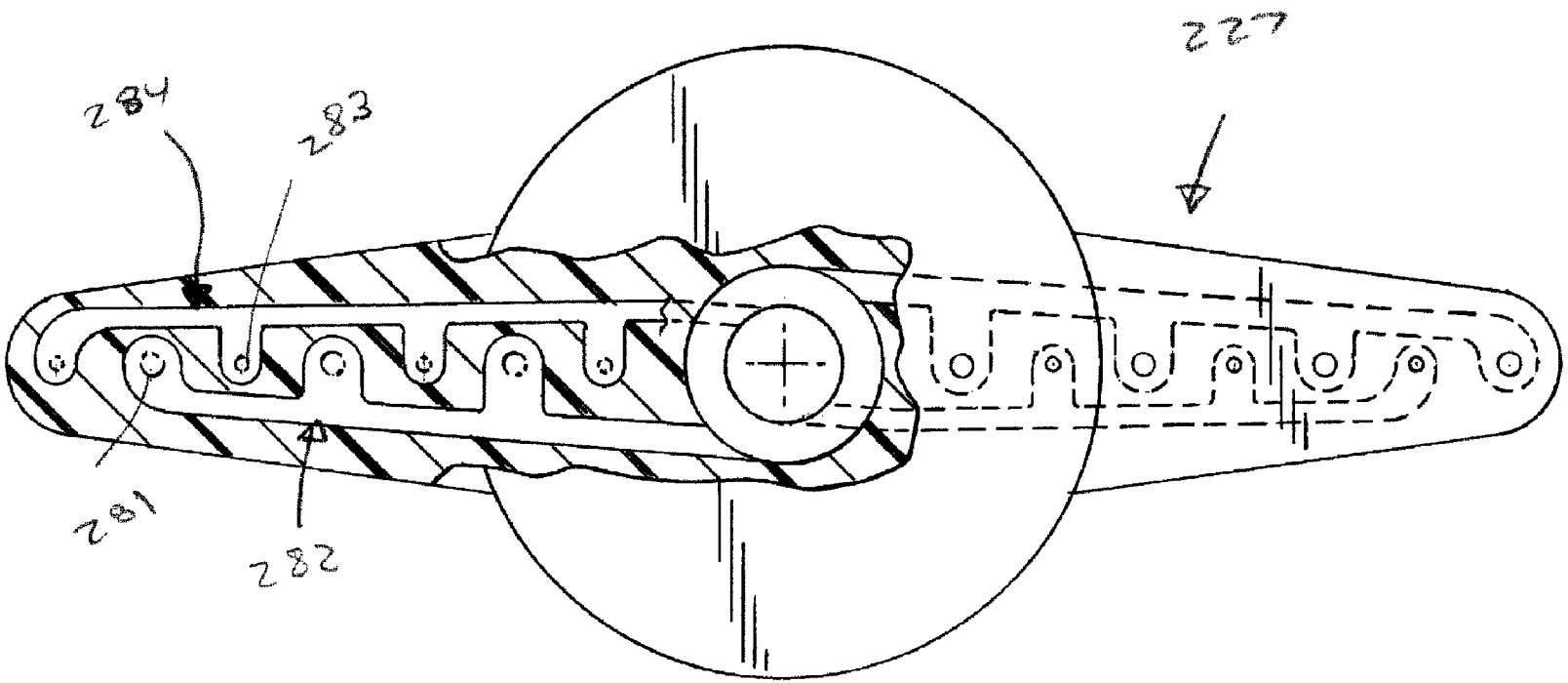

As shown in FIGS. 6-8, the present disclosure provides alternative middle spray arm embodiments 127 (FIGS. 6) and 227 (FIG. 8) with the ability to spray, for example, an inner annular region 182A of dishes via orifices 177 and 181 distributed along a first section 182 of spray arm 127, or an outer annular region 184A , via orifices 180 and 179 distributed along a second section 184 of spray arm 127. Section 182 comprises a hollow portion of spray arm 127 that is in fluid communication with its respective conduit (not shown) and inlet hub 128, and section 184 comprises a hollow portion segregated from section 182 and in fluid communication with its respective conduit (not shown) and hub 128. More specifically, orifices 177 and 181 are distributed along one or both of the upper and lower surfaces of section 182 such that when spray arm 127 completes a full rotation, the orifices sweep annular region 182A. Orifices 179 and 180 are distributed along section 184 of spray arm 127 such that as spray arm 127 completes a full rotation, orifices 179 and 180 sweep the annular region 184A. Orifices 179 and 180 are disposed at a greater radial distance from hub 128 relative to orifices 177 and 181. Consequently the annular region 184A circumscribes annular region 182A. Spray arm 127 has the ability to spray dishes upward using orifices 177, 179 and/or downward using orifices 180, 181.

A targeted area to the side such as a heating element 135 can be sprayed via outwardly directed orifices 131 in the alternate bottom spray arm embodiment 125 for enhanced heat transfer. Alternative spray arm embodiment 227 (i.e. middle spray arm) has the ability to provide a relatively high velocity spray using orifices 283 from manifold 284 or relatively slow velocity spray using orifices 281 from manifold 282. It is to be appreciated that the orifices 281, 283 can be of different diameters to facilitate the respective spray velocities. Any number and combination of the multiple modes described above can be implemented with this disclosure.

Referring again to FIGS. 2-3, wherein single rack wash modes are illustrated. A ball valve, breakthrough ball valve, or magnetic ball valve 50 can be utilized to block water flow to the lower spray arm 25, wherein the water is then directed to the mid spray arm 27 and upper spray arm 29. In one illustrative example, valve 50 can selectively divert the water supply to a lower spray arm (LSA) 25. The valve 50 can be assembled within the conduit 22 and allow selective flow or shut-off of water. The conduit valve 50 can consist of a magnetically controlled flapper or magnetic ball valve mechanism (not illustrated) where the magnetic transparency of the stainless steel tub bottom may be utilized to keep the electrical portion of the conduit valves on the dry side of the tub to either shut off water flow or allow water flow. A ball can be contained within the conduit 22 and can be magnetically held in place remote from a sealing orifice when a valve actuator is de-energized, for example. A magnet can be located on one end of the valve actuator to hold the ball against the conduit wall and to allow water to flow therethrough. The magnet can include enough attraction in order to hold the ball through the stainless steel tub wall and the conduit wall. Because the magnetic ball valve can work through the stainless steel tub, a hole is not necessary through the tub wall or the conduit wall. This alleviates the potential for leaks. A motor, i.e. a wax push motor (not illustrated), can be positioned at a distal end relative to the magnet. When energized, the motor can push the distal end of the actuator thereby pivoting the magnet away from the tub wall. The ball is then free to move within the conduit and can then travel with the flow of water into a sealing orifice thereby stopping the flow of water.

In particular, the water can be diverted into conduit 44, and into conduit 62 of the mid spray arm 27, wherein the water is directed to an upper compartment or first projection 76 such that the water is channeled and sprayed upward during a wash cycle. As shown in FIG. 3, the water flow can be diverted to the lower spray arm 25 and a mid spray arm 27, and blocked from the upper spray arm 29. In this embodiment, the water flow can be further channeled to the mid spray arm 27 via conduit 42, 64 wherein the water flows to a lower compartment or second projection 78 wherein the water flows downward during a wash cycle. The upper compartment 76 is defined by dividing wall 74 and an upper wall 75 of the spray arm. Similarly, the lower compartment 78 is defined by a lower wall 73 and the dividing wall 74 of the spray arm. In one selected arrangement, the water is directed to the upper compartment 76 and during a wash cycle is projected through the orifices 77 of the upper wall 75. In another arrangement, the water is directed to the lower compartment 78 and during the wash cycle the water is projected downward through the orifices 79 of the lower wall 73. It is to be appreciated that if the wash cycle includes a single upper rack mode or a single lower rack mode, the water will be directed to the upper compartment 76 and the lower compartment 78, respectively, of the mid spray arm 27. If the wash cycle includes a normal wash, both racks, the water can be directed to both the upper compartment 76 and the lower compartment 78 wherein the water is projected outward through the orifices 77, 79 of both the upper wall 75 and the lower wall 73. The water being directed to both the upper and lower compartments 76, 78 can either be simultaneous and/or alternating from upper to lower and back again. The mid spray arm 27, conduit and conduit valve system can be controlled such that the water sprays upward and/or downward as desired.

As shown in FIGS. 1-3, examples of conduit systems are therein shown. The diverter valves 50, 52 are positioned such that water can be diverted to or from the lower spray arm 25, the mid spray arm 27, and/or the upper spray arm 29. As displayed, the mid spray arm 27 includes a dual mid conduit 62, 64 that can provide water flow to either an upper compartment or a first compartment 76, a lower compartment or second compartment 78, or to both the upper and lower compartments 76, 78. As shown in FIG. 8, the orifices 281, 283 of the respective first section 282 and second section 284 can be different thereby affecting flow rates from the first section and second section. Although not shown, it is to be appreciated that the water can be delivered to spray arms 127, 227 utilizing the conduit and valve arrangement as per the description for spray arm 27. Similarly, water can be diverted to spray arm 125 utilizing the conduit and valve arrangement as per the description for spray arm 25. It is further to be appreciated that water can flow from a variety of combinations of the middle spray arm embodiments 27, 127, 227, for example, first section, second section, first and second sections concurrently, first and second sections alternating, first section upward, first section downward, second section upward, second section downward, first and second concurrently upward, first and second concurrently downward, alternating first and second upward, first and second downward, and differing flow rates from the first section relative to the second section It should be apparent to those skilled in the art that the embodiments described heretofore are considered to be the presently preferred forms of this disclosure. In accordance with the Patent Statutes, changes may be made in the disclosed mechanism and in the manner in which it is used without actually departing from the true spirit and scope of this disclosure.

The invention claimed is:

1. A spray assembly for an automatic dishwasher comprising:

a multi conduit system for receiving pressurized washing liquid;

an upper spray arm including a plurality of orifices formed in a lower surface for distributing said liquid therebelow;

an elongated mid spray arm including an upper surface and a lower surface;

said mid spray arm including a dividing wall between said upper surface and said lower surface;

said mid spray arm including a plurality of orifices formed in said upper surface and said lower surface for distributing said liquid throughout the dishwasher;

said dividing wall and said upper surface defining an upper interior compartment and said dividing wall and said lower surface defining a lower interior compartment;

said multi conduit system including a water feed system and a water diverting mechanism for selectively diverting water into said upper compartment, said lower compartment, or both said upper and said lower compartments of said mid spray arm;

a lower spray arm including a plurality of orifices formed in an upper surface for distributing said liquid thereabove;

said diverting mechanism further includes a diverter valve for selectively diverting liquid to or from said upper spray arm, said mid spray arm, and said lower spray arm;

said multi conduit system and said diverting mechanism selectively supplies liquid to said upper spray arm only, to said mid spray arm only, to said lower spray arm only, to said upper and said mid spray arms only, to said mid and said lower spray arms only, to said upper and said lower spray arms only, or to said upper, said mid, and said lower spray arms;

wherein said multi conduit system includes a dual annulus inlet and dual conduits for providing two distinct water flow paths to said mid spray arm;

wherein a first water flow path includes said upper compartment of said mid spray arm and a second water flow path includes said lower compartment of said mid spray arm;

wherein in a first mode, said water diverting mechanism directs water only to said upper compartment of said mid spray arm and through said orifices of said upper surface via said first flow path during a wash cycle;

wherein in a second mode, said water diverting mechanism directs water only to said lower compartment of said mid spray arm and through said orifices of said lower surface via said second flow path during a wash cycle;

wherein in a third mode said water diverting mechanism directs water to said upper and said lower compartments of said mid spray arm and through said orifices of said upper surface and said lower surface of said mid spray arm via said first and second flow paths respectively during a wash cycle;

wherein in a fourth mode, said water diverting mechanism selectively alternates and directs water to said upper compartment and through said orifices of said upper surface of said mid spray arm or to said lower compartment and through said orifices of said lower surface of said mid spray arm via said first and second flow paths respectively during a wash cycle;

wherein said orifices of said upper surface of said mid spray arm are different in size from said orifices of said lower surface of said mid spray arm;

wherein said orifices of said upper surface of said mid spray arm are smaller than said orifices of said lower surface of said mid spray arm;

said orifices of said lower surface of said mid spray arm provide a higher water flow rate than said orifices of said upper surface of said mid spray arm;

wherein said plurality of orifices formed in said upper surface form an array along the length of said mid spray arm such that when said mid spray arm rotates said orifices pass over a first annular region around an inlet hub of said mid spray arm;

wherein said plurality of orifices formed in said lower surface form an array along the length of said mid spray arm such that when said mid spray arm rotates said orifices pass over a second annular region around said inlet hub; and, wherein said second annular region circumscribes said first annular region.

* * * * *